US007696966B2

(12) United States Patent
Sun et al.

(10) Patent No.: US 7,696,966 B2
(45) Date of Patent: Apr. 13, 2010

(54) LIQUID CRYSTAL DISPLAY AND DRIVING METHOD THEREFOR

(75) Inventors: Wein-Town Sun, Taoyuan County (TW); Chien-Chih Chen, Hsinchu County (TW)

(73) Assignee: AU Optronics Corp., Hsin-Chu (TW)

( * ) Notice: Subject to any disclaimer, the term of this patent is extended or adjusted under 35 U.S.C. 154(b) by 924 days.

(21) Appl. No.: 11/456,871

(22) Filed: Jul. 12, 2006

(65) Prior Publication Data

US 2007/0080914 A1 Apr. 12, 2007

(30) Foreign Application Priority Data

Oct. 12, 2005 (TW) ..... 94135580 A

(51) Int. Cl.
*G09G 3/36* (2006.01)

(52) U.S. Cl. ..... 345/89

(58) Field of Classification Search ..... 345/88, 345/89

See application file for complete search history.

(56) References Cited

U.S. PATENT DOCUMENTS

| | | | | |
|---|---|---|---|---|
| 5,436,747 | A * | 7/1995 | Suzuki | 349/42 |
| 6,225,967 | B1 * | 5/2001 | Hebiguchi | 345/88 |
| 6,243,055 | B1 * | 6/2001 | Fergason | 345/32 |
| 6,424,328 | B1 | 7/2002 | Ino et al. | |
| 6,577,290 | B2 * | 6/2003 | Yeo | 345/88 |
| 7,505,017 | B1 * | 3/2009 | Yeo et al. | 345/88 |

FOREIGN PATENT DOCUMENTS

JP 2000181394 6/2000

* cited by examiner

*Primary Examiner*—Richard Hjerpe
*Assistant Examiner*—Carolyn R Edwards
(74) *Attorney, Agent, or Firm*—Thomas, Kayden, Horstemeyer & Risley

(57) ABSTRACT

A liquid crystal display and its driving method are disclosed. Among the pixels driven by the same data driving unit, firstly the pixels of same color are sequentially driven, and then the pixels of other colors are sequentially driven, so that the pixels have almost the same leakage current.

10 Claims, 9 Drawing Sheets

LIQUID CRYSTAL DISPLAY AND DRIVING METHOD THEREFOR

This application claims the benefit of Taiwan Patent Application Ser. No. 94135580, filed Oct. 12, 2005, the subject matter of which is incorporated herein by reference.

BACKGROUND OF THE INVENTION

1. Field of the Invention

The invention relates in general to a liquid crystal display and a driving method therefor, and more particularly to a driving sequence with a plurality of pixels being driven by a data driving unit.

2. Description of the Related Art

In a conventional liquid crystal display, the data driver has a plurality of data driving units, such as N data driving units, where N is a positive integer. Each data driving unit has a sampling maintenance circuit, a shift register and a digital-to-analog converter. The N data driving units are electrically connected to N data lines for respectively outputting pixel voltages to their corresponding data lines, so that the pixel electrically connected to the data line can receive its corresponding pixel voltage. That is, according to the above design, N data driving units are required if the pixel array of liquid crystal display has N column pixels. However, when the trend in design of the liquid crystal display is headed towards large scale such as liquid crystal TV, the scale of the pixel array increases and so does the required number of data driving units. Thus, the data driver needs a large amount of data driving units, further increasing manufacturing costs.

Therefore, how to reduce the manufacturing cost yet maintain the image quality of a large scaled liquid crystal display has become an imminent issue to be resolved.

SUMMARY OF THE INVENTION

It is therefore an object of the invention to provide a liquid crystal display and the driving method therefore, not only reducing the manufacturing cost but also enhancing the image quality of the liquid crystal display.

The invention achieves the above-identified object by providing a liquid crystal display comprising a plurality of first color pixels, at least a second color pixel, a scan driving circuit, and a data driving unit. The above scan driving circuit outputs a scanning signal to a scan line. The output end of the above data driving unit is selectively and electrically connected to the first color pixels and the second color pixel. The first color pixels and the second color pixel are both electrically connected to the scan line. The method for driving a liquid crystal display according to an embodiment of the invention comprises the following steps of enabling a scanning signal, sequentially driving the first color pixels by the data driving unit, and driving the second color pixel by the data driving unit.

The invention achieves the above-identified object by providing another technical protocol. A liquid crystal display comprises N pixels, a data driving circuit, N switches and a scan driving circuit. The N pixels are electrically connected to a scan line. The N pixel comprise X first color pixels, Y second color pixels and Z third color pixels. The N pixels are arranged according to the order in generating the first color light source, the second color light source, and the third color light source, where N, X, Y, and Z are positive integers and X+Y+Z=N.

The above data driving circuit has an output end. Each switch has a first ends and a second end. The first ends of the N switches are electrically connected to the output end, and the second ends of the N switches are respectively and electrically connected to corresponding pixel. The data driving circuit is selectively and electrically connected to the N pixels via the switches. The above scan driving circuit outputs a scanning signal to the scan line. When scanning signal is enabled, the N switches are sequentially turned on, such that the data driving circuit sequentially drives the X first color pixels first, then sequentially drive the Y second color pixels, and sequentially drives the Z third color pixels at last.

Other objects, features, and advantages of the invention will become apparent from the following detailed description of the preferred but non-limiting embodiments. The following description is made with reference to the accompanying drawings.

DETAILED DESCRIPTION OF THE INVENTION

Figure 1:
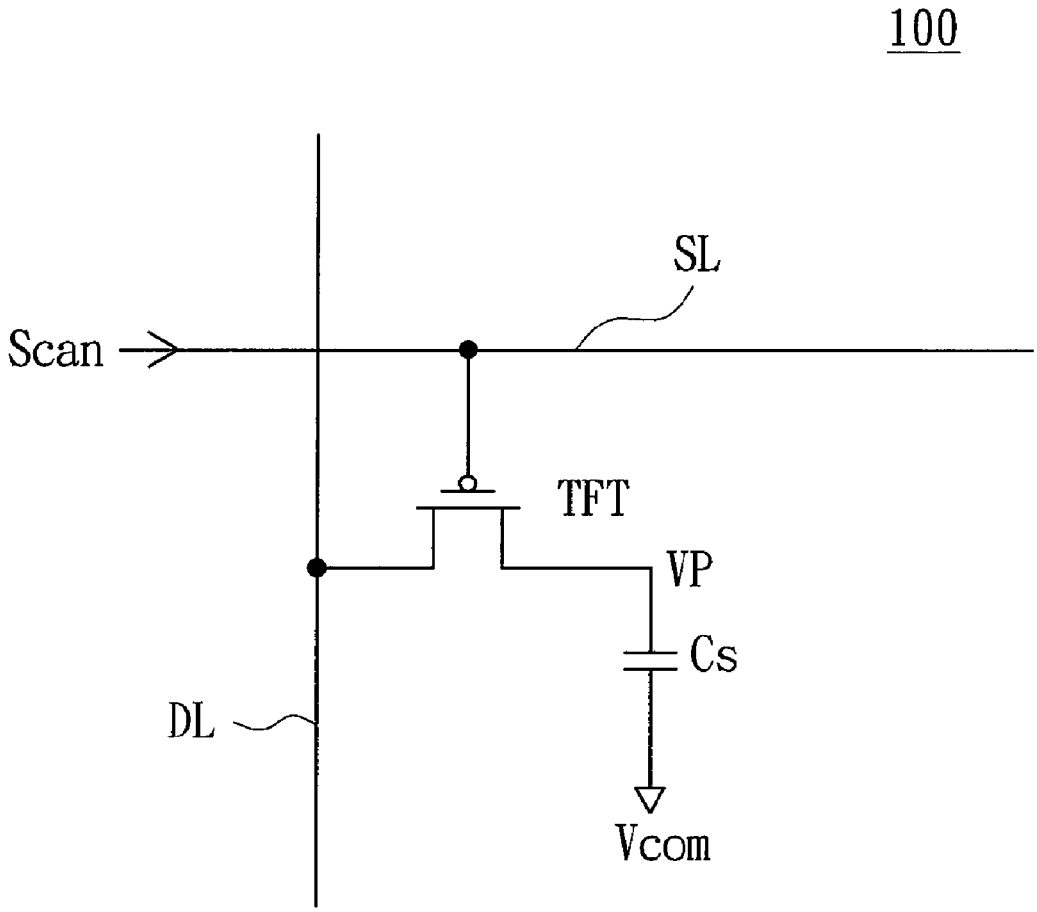
FIG. 1 is a diagram showing an example of a pixel equivalent circuit.
Figure 5:
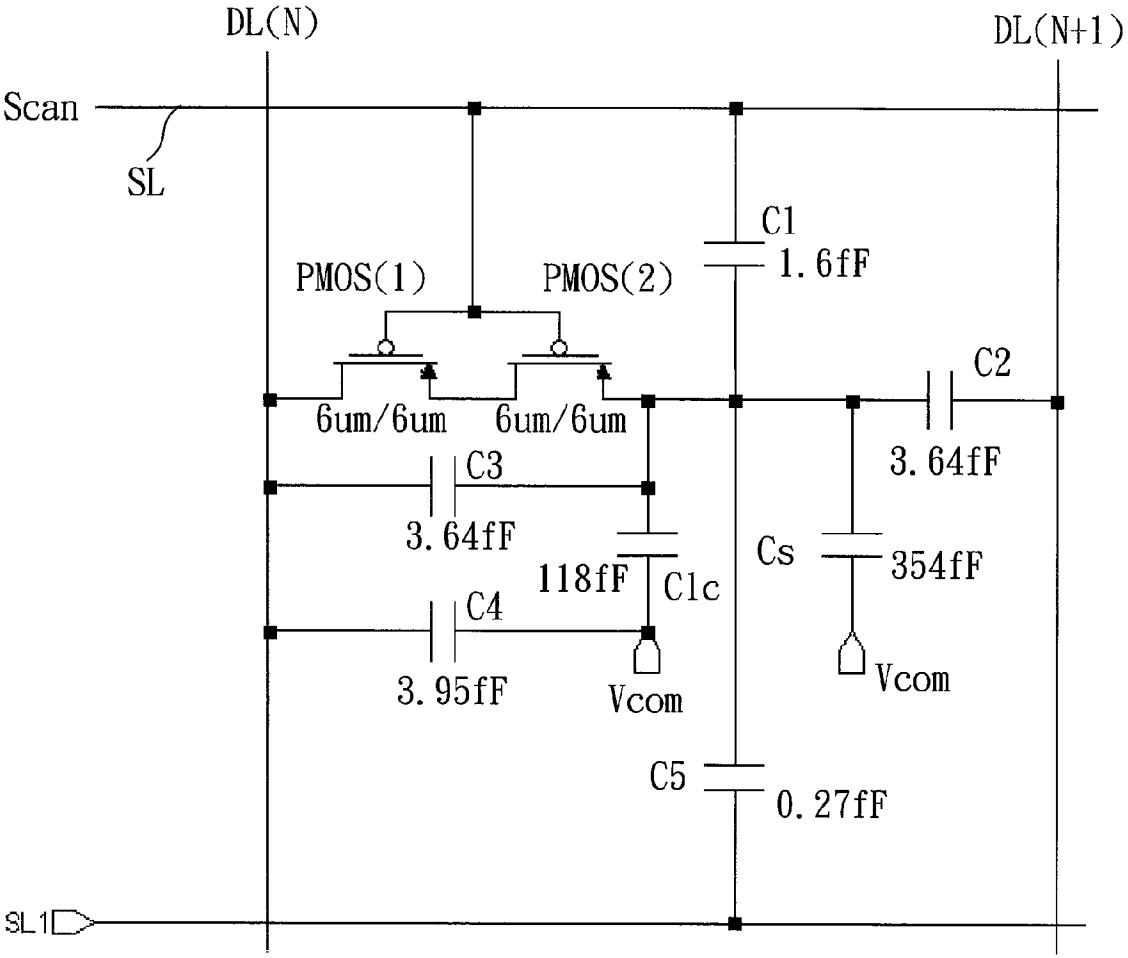
FIG. 5 shows the parameters of components of the pixel circuit.

Referring to FIG. 1, an example of a pixel equivalent circuit is shown. The pixel 100 includes a thin-film transistor TFT used as a switch, a storage capacitor Cs and a liquid crystal capacitor Clc. The liquid crystal capacitor Clc is illustrated in FIG. 5. The thin-film transistor TFT can be a P-type thin-film transistor whose gate and source are respectively coupled to a scan line SL and a data line DL, and whose drain is coupled to the common electrode voltage Vcom via the liquid crystal capacitor Clc and the storage capacitor Cs. The common electrode voltage Vcom is referred as the "Vcom voltage" hereafter. When a scanning signal Scan on the scan line SL is enabled, for example, the scanning signal Scan changes to −6V, the thin-film transistor TFT is turned on. Since the thin-film transistor TFT is turned on, the pixel voltage on the data line DL can be stored in the liquid crystal capacitor Clc and the storage capacitor Cs.

Figure 2:
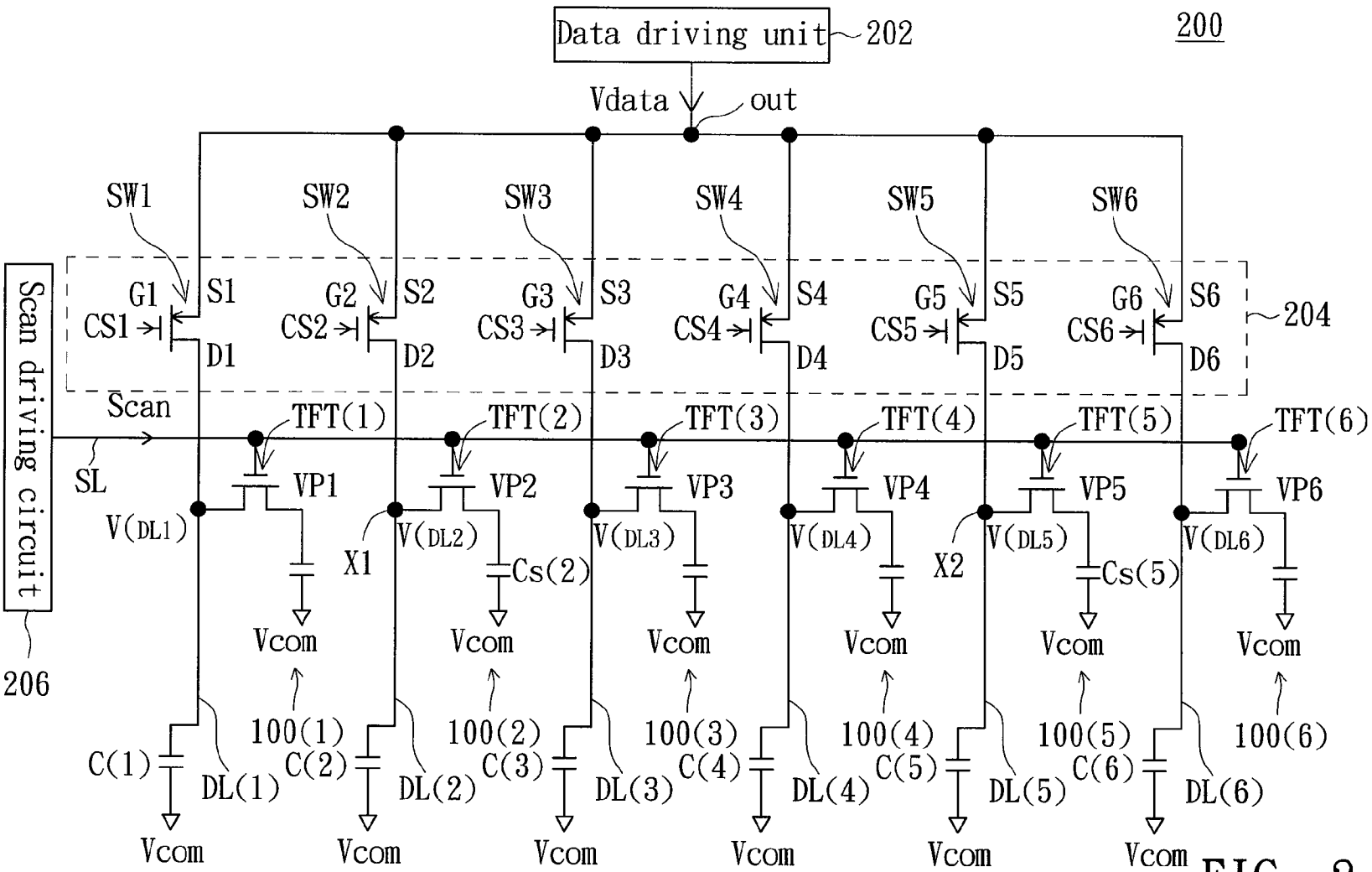
FIG. 2 is a diagram showing partial circuit structure of a liquid crystal display.

Referring to FIG. 2, a diagram showing partial circuit structure of a liquid crystal display is shown. The liquid crystal display 200 includes a data driving unit 202, a switch set 204, a scan driving circuit 206 and a pixel array 208. The pixel array 208 is exemplified by six pixels 100(i)~100(6). The six pixels 100(1)~100(6) are arranged from left to right in the order of red, green, blue colors. That is, the pixels 100(1) and 100(4) are red (R) pixels, the pixels 100(2) and 100(5) are green (G) pixels, and the pixels 100(3) and 100(6) are blue (B) pixels. The data driving unit 202 is for driving the above pixels 100(1)~100(6), for example, for sequentially outputting a plurality of pixel voltages at an output end OUT according to RGB data. The scan driving circuit 206 is electrically connected to the scan line SL for outputting the scanning signal Scan.

Figure 3:
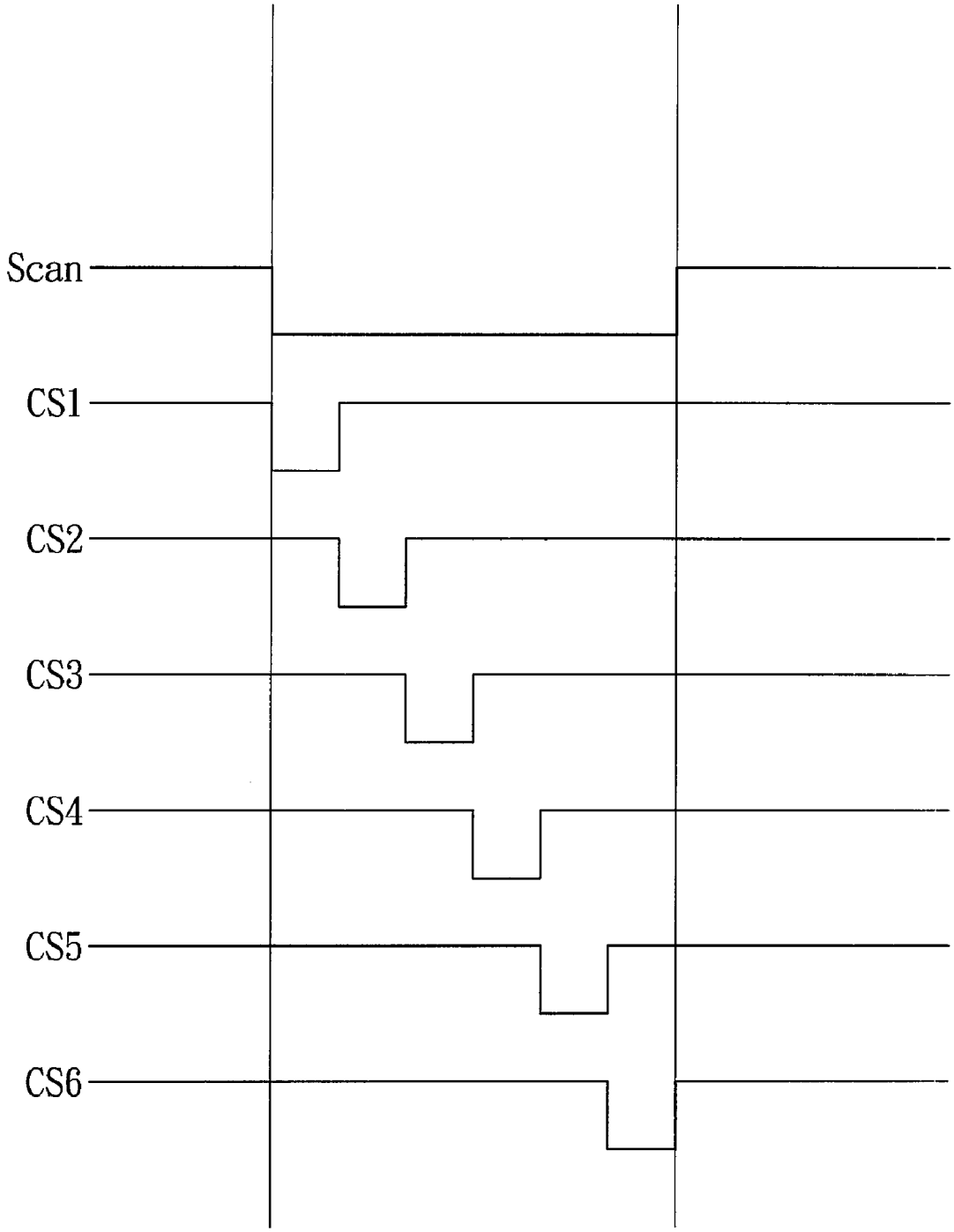
FIG. 3 is the timing diagram of the scanning signal Scan and the switch controlling signals CS1~CS6.

The switch set 204 includes six switches SW1~SW6. The six switches SW1~SW6 can be P-type thin-film transistors. The six ends S1~S6 of the switches SW1~SW6 are all coupled to the output end OUT of the data driving unit 202, and the other six ends D1~D6 of the switches SW1~SW6 are respectively coupled to their corresponding pixels 100 via their corresponding data lines DL. The six controlling ends (the gate) G1~G6 of the switches SW1~SW6 respectively receive their corresponding switch controlling signals CS1~CS6. In the following description, the term "switch controlling signal CS" is used to refer to any one of signals CS1~CS6, and the term "enabled period" means the period during which the relating signal is enabled. The controlling signals CS1~CS6 are sequentially enabled within the enabled period of the scanning signal Scan for sequentially controlling the switches SW1~SW6 to be turned on. The switches SW1~SW6 are sequentially turned on so that each of the six pixels 100(1)~100(6) sequentially receives its corresponding pixel voltage. Referring to FIG. 3, the timing diagram of the scanning signal Scan and the switch controlling signals CS1~CS6 is shown. When the scanning signal Scan is enabled, for example, the scan driving circuit 206 outputs a scanning signal Scan of low level (for example, −6V), all the thin-film transistors (TFTs) of the six pixels 100(1)~100(6) used as switches are turned on. Meanwhile, as shown in FIG. 3, the six switch controlling signals CS1~CS6 are sequentially enabled, for example, are of low level (−6V). The data driving unit 202 sequentially outputs six pixel voltages to their corresponding pixels 100 when the six switches SW1~SW6 are respectively turned on. For example, when the switch controlling signal CS1 is enabled so as to turn on the switch SW1, the data driving unit 202 outputs the pixel voltage corresponding to the pixel 100(1). Meanwhile, the remaining switches SW2~SW6 are turned off. Next, when the switch controlling signal CS2 is enabled so as to turn on the switch SW2, the data driving unit 202 outputs the pixel voltage corresponding to the pixel 100(2). Similarly, within the enabled period of the scanning signal Scan, the data driving unit 202 sequentially drives the six pixels 100(1)~100(6) from left to right in the order of RGB colors.

According to the above structure, that is, the six pixels 100(1)~100(6) are driven by one data driving unit 202, the required number of data driving units 202 can be reduced, and so are the manufacturing costs of the liquid crystal display 200 reduced. However, during the above driving process, all of the six thin-film transistors TFT(1)~TFT(6) of the pixel 100 used as switches have leakage current currents. The electric charges stored in the storage capacitor Cs would be respectively discharged via their corresponding thin-film transistors TFTs, so that the pixels 100 can not achieve the expected luminance when displayed, hence reducing the overall image quality.

Figure 4A:
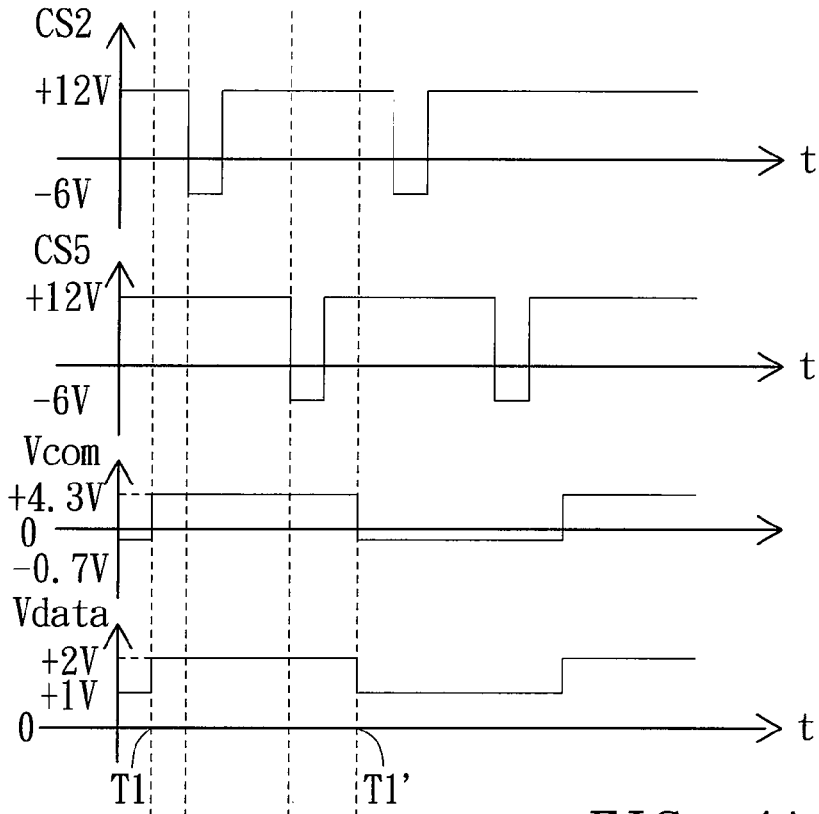
FIG. 4A is a timing diagram of the switch controlling signals CS2 and CS5, the common electrode voltage Vcom and the pixel voltage Vdata provided by the data driving unit 202.

The pixels 100(2) and 100(5) are used as an example explaining why the pixels have different leakage currents. Referring to FIG. 4A, a timing diagram of the switch controlling signals CS2 and CS5, the common electrode voltage Vcom and the pixel voltage Vdata provided by the data driving unit 202 is shown. As shown in FIG. 4A, assume that all of the six pixels 100(1)~100(6) receive the same pixel voltage Vdata. That is, the data driving unit 202 sequentially outputs +2V and +1V pixel voltages Vdata, and drives the pixels 100 in the manner of row-inversion. Row-inversion driving means that the voltage of the above Vcom voltage is periodically switched between a high voltage level and a low voltage level. For example, the high voltage level is +4.3V and the low voltage level is −0.7V.

Figure 4B:
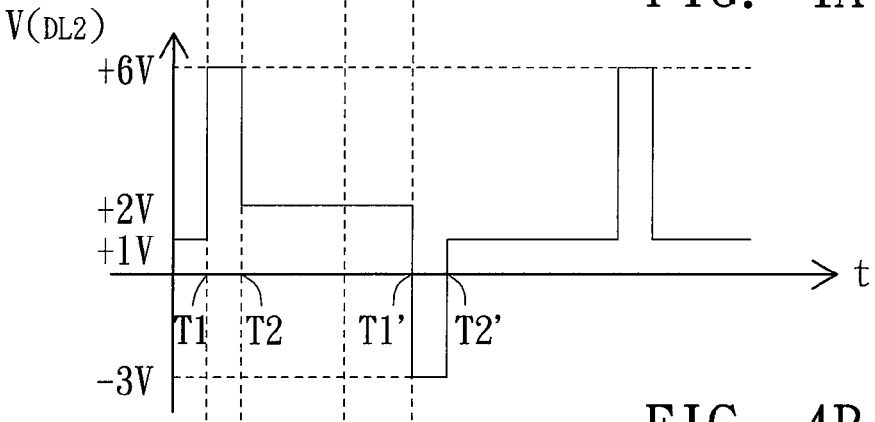
FIG. 4B is a diagram showing changes of voltage on the data line DL(2)

First of all, the changes of the voltage V(DL2) on the second data line DL(2) during display period are observed. As shown in FIG. 2, the voltage V(DL2) of the second data line DL(2) is exactly the same as the voltage of the source X1 of the second thin-film transistor TFT(2). As shown in the lower part of FIG. 2, the data lines DL(1)~DL(6) are respectively coupled to the Vcom voltage via capacitor C(1)~C(6) respectively. When the Vcom voltage changes, the voltages V(DL1)~V(DL6) on the data lines DL(1)~DL(6) would change accordingly due to the continuity of the voltages between two ends of the capacitor C. Referring to FIG. 4B, a diagram showing changes of the voltage on the data line DL(2) is shown. Before the Vcom voltage is switched to the high voltage level (+4.3V for instance), the voltage V(DL2) on the second data line DL(2) is maintained at the voltage (+1V) of previous pixel voltage. After the Vcom voltage is switched to the high voltage level at time point T1 labeled in FIG. 4B, the voltage V(DL2) on the data line DL(2) changes to +6V along with the change in the Vcom voltage (increase by +5V) and maintains at +6V for an enabled period of the switch controlling signal CS. After having been maintained for about an enabled period of the switch controlling signal CS, the voltage V(DL2) changes from +6V to a +2V pixel voltage outputted by the data driving unit 202 and maintains at +2V for about five enabled periods of the switch controlling signals CS after time point T2 at which the second switch SW2 is turned on. Similarly, after time point T1', the Vcom voltage changes to a low voltage level (−0.7V), and the voltage V(DL2) changes to −3V along with the change in the Vcom voltage (decrease by 5V) and maintains at −3V for about one enabled period of the switch controlling signal CS. When the second switch SW2 is turned on again after time point T2', the −3V voltage V(DL2) changes to +1V pixel voltage outputted by the data driving unit 202 and maintains at +1V for about five enabled periods of the switch controlling signals CS.

Figure 4C:
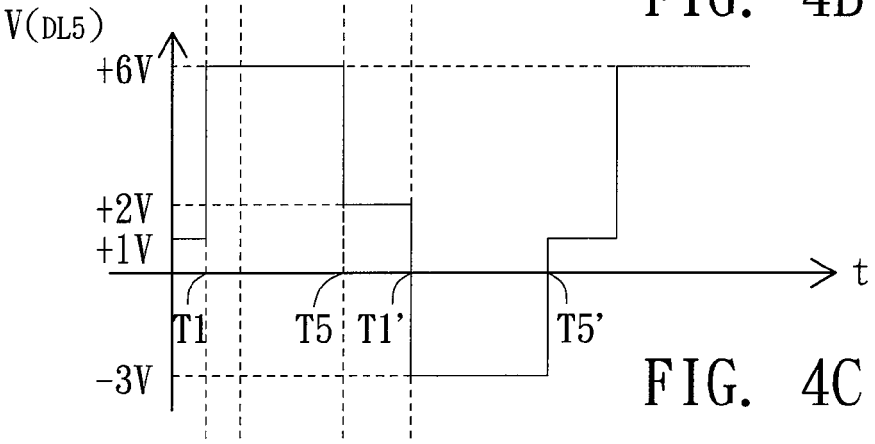
FIG. 4C is a diagram showing changes of voltage on the data line DL5.

Next, the changes of the voltage V(DL5) on the fifth data line DL(5) are observed. As shown in FIG. 2, the voltage V(DL5) on the fifth data line DL(5) is exactly the same as the voltage of the source X2 of the fifth thin-film transistor TFT (5). Referring to FIG. 4C, a diagram showing changes of voltage on the data line DL5 is shown. As disclosed above, before the Vcom voltage changes to a high voltage level, the voltage V(DL5) on the data line DL(5) maintains at +1V. After the Vcom voltage changes to the high voltage level at time point T1, the voltage V(DL5) also changes to +6V along with the change of the Vcom voltage and maintains at +6V for about four enabled periods of the switch controlling signals CS. Then, the voltage V(DL5) changes from +6V to a +2V pixel voltage outputted by the data driving unit 202 and maintains at +2V for about two enabled periods of the switch controlling signals CS after the time point T5 at which the fifth switch SW5 is turned on. Next, after time point T1', when the Vcom voltage changes to a low voltage level, the voltage V(DL5) of the data line DL(5) changes to −3V along with the change of the Vcom voltage and maintains at −3V for about four enabled periods of the switch controlling signals CS. After time point T5' at which the switch SW5 is turned on, the voltage V(DL5) changes from −3V to a +1V pixel voltage outputted by the data driving unit 202 and maintains at +1V for about two an enabled periods of the switch controlling signals CS.

By comparing FIG. 4B and FIG. 4C, the differences between the changes of the voltage of the source X1 of the second thin-film transistor TFT(2) and the changes of the voltage of the source X2 of the fifth thin-film transistor TFT (5) after the two pixels 100(2) and 100(5) have respectively received their corresponding pixel voltages Vdata (for example, +2V) can be realized. The greater the difference between the voltages on the source and the drain of the thin-film transistor is, or the longer the voltage difference would last for, the more the leakage current through the source and the drain of the thin-film transistor. After time point T1', the duration that the source X2 of TFT(5) maintains at −3V is longer than the duration that the source X1 of TFT(2) maintains at −3V, and the duration that the source X2 of TFT(5) maintains at +6V is also longer than the duration that the source X1 of TFT(2) maintains at +6V. Therefore, the leakage current through the thin-film transistor TFT(5) would be larger than the leakage current through the thin-film transistor TFT(2), which result the voltage VP5 labeled in FIG. 2 to be lower than voltage VP2. The voltage VP5 is the voltage at the node connecting the drain of the thin-film transistor TFT(5) and the storage capacitor Cs(5). Similarly, the voltage VP2 is the voltage at the node connecting the drain of the thin-film transistor TFT(2) and the storage capacitor Cs(2). Under ideal circumstances, both the voltage across the storage capacitor Cs(2) of the second pixel 100(2) and the voltage across the storage capacitor Cs(5) of the fifth pixel 100(5) should the same, and VP2 and VP5 are both +2V. However, the difference between the magnitude of the leakage current through the thin-film transistor TFT(2) and the magnitude of the leakage current through the thin-film transistor TFT(5) would cause the pixels 100(2) and 100(5) to store different amounts of electric charges and cause voltage VP2 and VP5 to be of different values. That is, despite receiving the same pixel voltage such as +2V for instance, the pixel 100(5) and the pixel 100(2) would have different luminance.

Figure 6:
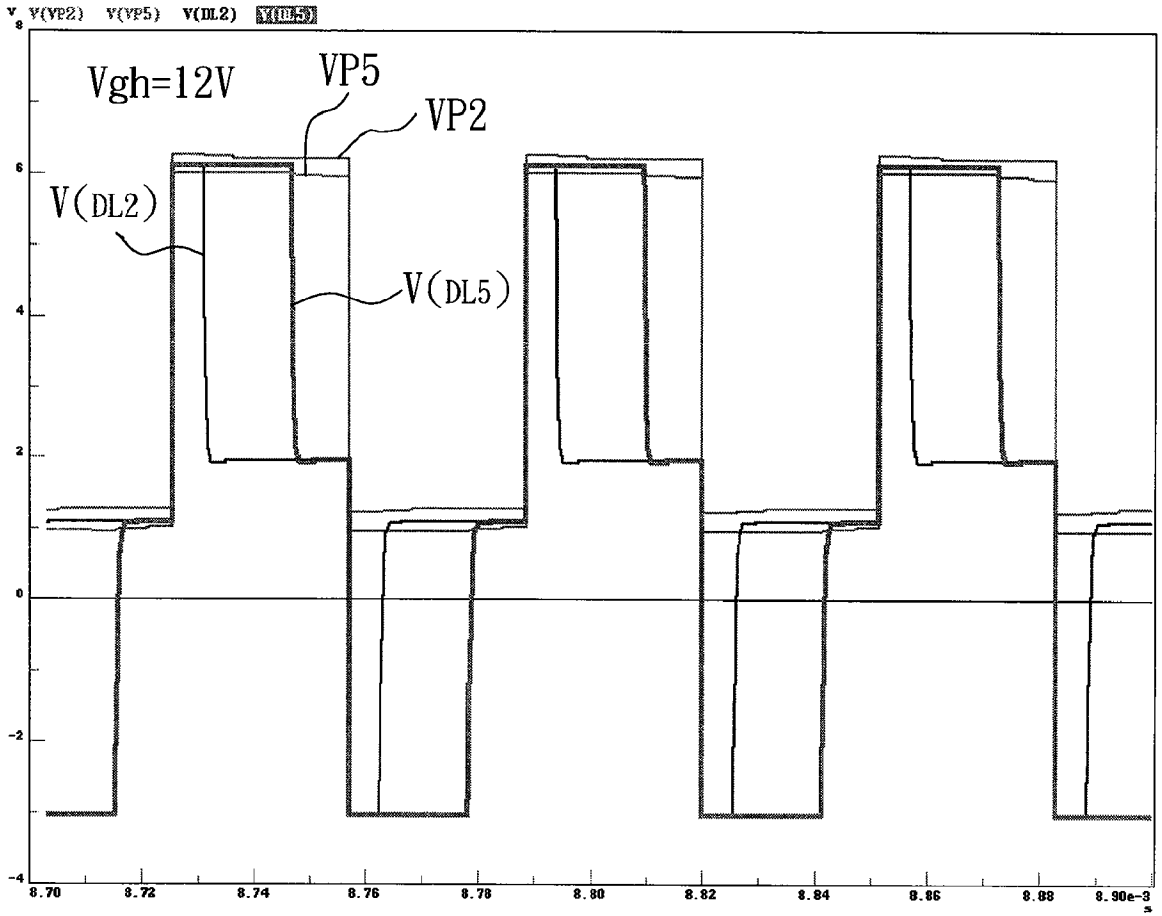
FIG. 6 shows the waveform of the result of simulation.

The embodiment is further exemplified by the results of circuit simulation. Referring to FIG. 5, parameters of components of the pixel circuit is shown. As shown in FIG. 5, the pixel circuit of FIG. 1 is used as an example, and the thin-film transistors TFTs used as switches are respectively achieved by PMOS(1) and PMOS(2) whose W/L ratio is 6 um/6 um. The capacitance of storage capacitor Cs and the capacitance of the liquid crystal capacitor Clc are respectively equal to 354 fF and 118 fF. As for parasitic capacitors, the capacitances of the parasitic capacitors C1, C2, C3, C4 and C5 shown in FIG. 5 are respectively equal to 1.6 fF, 3.64 fF, 3.64 fF, 3.95 fF and 0.27 fF. Next, referring to FIG. 6, the waveform showing the result of simulation is shown. FIG. 6 shows a waveform of the voltages VP2 and VP5 as well as a waveform of the voltages V(DL2) and voltage V(DL5) under the conditions of FIG. 4A and FIG. 5. In FIG. 6, the horizontal axis represents time unit measured in seconds (s), the vertical axis represents voltage unit measured in volts (V). It can be seen from the simulation results of FIG. 6 that when the switches SW1~SW6 are turned on according to the timing diagram of FIG. 3, the leakage current difference between the thin-film transistor TFT(2) and the thin-film transistor TFT (5) would cause the pixel 100(2) and the pixel 100(5) to have different storages of electric charges. That is, when receiving the same pixel voltage such as +2V for instance, the voltage VP2 on the pixel 100(2) is larger than the voltage VP5 on the pixel 100(5), so that the pixel 100(5) and the pixel 100(2) would have different luminance. Finally, when adjacent pixels of the same color in each row have different leakage currents which results in different voltages stored in storage capacitors of adjacent pixels, the image quality would be largely reduced.

To summarize, pixels have different voltage drops in corresponding storage capacitors Cs due to difference leakage currents in their corresponding thin-film transistors TFTs. For two thin-film transistors TFTs, the leakage current difference occurs due to the average voltage difference between the source and the drain. As long as the average voltage difference between the source and the drain is reduced, the difference in leakage current would be reduced accordingly. The average voltage is determined by the magnitude of and the duration of the voltage between the source and the drain. For example, if the waveform in FIG. 4B and the waveform in FIG. 4C are almost the same, the leakage current difference between the second thin-film transistor TFT(2) and the fifth thin-film transistor TFT(5) would be reduced as well. If the leakage current difference of the thin-film transistors is reduced, the corresponding pixels with the same gray level would have almost the same luminance so that the image quality can be enhanced.

The reduction in leakage current difference between thin-film transistors TFTs can be achieved by adjusting the timing of their corresponding switch controlling signals CS. That is, by adjusting the timing of the switch controlling signals CS2 and CS5, the durations that the source X1 maintains at −3V and +6V would be almost the same with the durations that the source X2 maintains at −3V and +6V respectively. In other words, when the pixels of the same color are sequentially driven, their corresponding thin-film transistors TFTs would have almost the same leakage current.

Therefore, the invention provides a method for driving liquid crystal display. Among the pixels driven by the same data driving unit, firstly the pixels of same color are sequentially driven, and then the pixels of another color are sequentially driven, so that the pixels of the same color would have almost the same leakage current, largely enhancing the of image quality of liquid crystal display.

First Embodiment

A method for driving a liquid crystal display according to the invention is applied to the liquid crystal display 200 of FIG. 2. At first, a plurality of first color pixels are sequentially driven, then a plurality of second color pixels and at last a plurality of third color pixels are sequentially driven. The first color pixels can be two red pixels 100(1) and 100(4), the second color pixels can be two green pixels 100(2) and 100 (5), and the third color pixels can be two blue pixels 100(3) and 100(6) for instance. The present embodiment does not limited what the first color pixels, the second color pixels and the third color pixels are. As long as the pixels of the same color are sequentially driven before the pixels of another color are sequentially driven would do.

Figure 7:
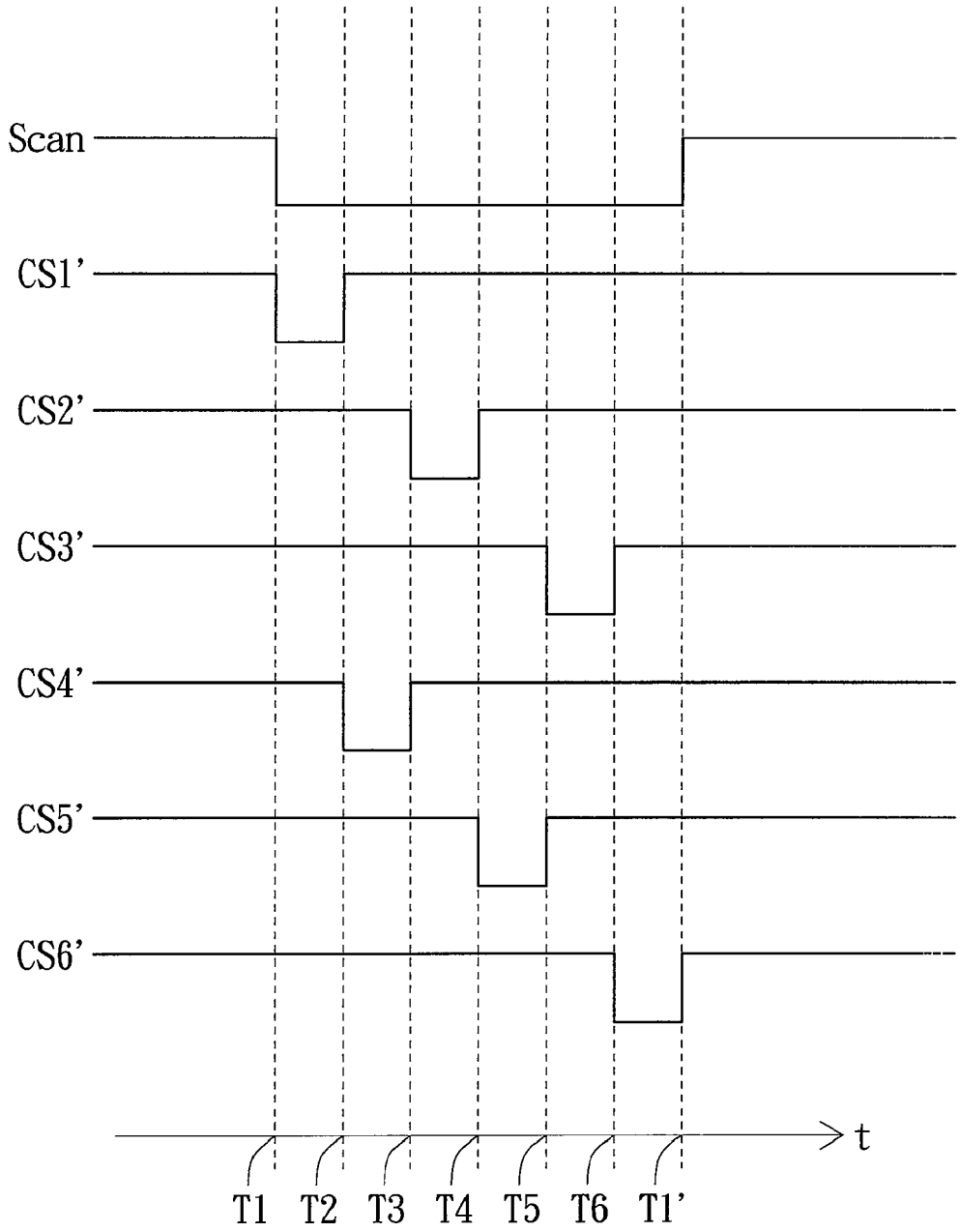
FIG. 7 is a timing diagram of the switch controlling signals CS1'~CS6' according to a first embodiment of the invention.

Referring to FIG. 7, a timing diagram of the switch controlling signals CS1'~CS6' according to a first embodiment of the invention is shown. Take the above example of driving the pixels in the order of the red pixels 100(1) and 100(4), the green pixels 100(2) and 100(5), and the blue pixels 100(3) and 100(6) for example. The switch controlling signals CS1'~CS6' are sequentially enabled according to the above driving method. That is, within the enabled period of the scanning signal Scan, the switch controlling signal CS1' is enabled first, then the switch controlling signals are sequentially enabled in the order of CS4', CS2', CS5', CS3' and CS6'. In the following description, the switch controlling signal CS' is used to refer to any one of signals CS1'~CS6'.

Figure 8A:
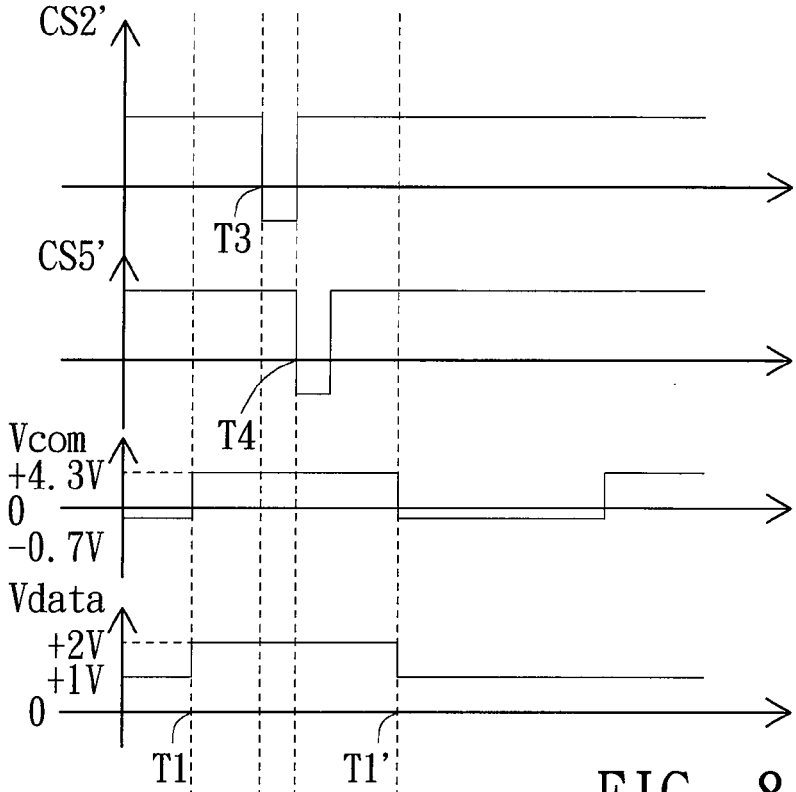
FIG. 8A is a timing diagram of the switch controlling signals CS2' and CS5', the common electrode voltage Vcom and the pixel voltage Vdata.

The reason why the pixels of the same color 100 would have almost the same leakage current if driven sequentially is further elaborated below. Again, the pixels 100(2) and 100(5) are used as an example to explain why the method according to the invention would produce almost the same leakage current. Referring to FIG. 8A, the timing diagrams of the switch controlling signals CS2' and CS5', the common electrode voltage Vcom and the pixel voltage Vdata is shown. The switch controlling signal CS' is enabled according to the timing of FIG. 7. Like what is disclosed above, the data driving unit 202 sequentially outputs a +2V pixel voltage and a +1V pixel voltage, and the voltage of the Vcom voltage is switched between a high voltage level and a low voltage level according to a fixed period.

Figure 8B:
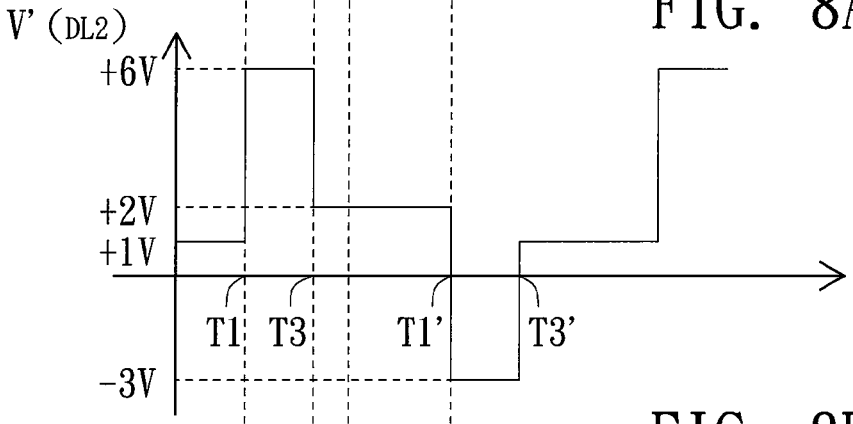
FIG. 8B is a diagram showing changes of voltage V(DL2) on the data line DL2.

Next, referring to FIG. 8B and FIG. 8A at the same time. FIG. 8B is a diagram showing changes of voltage V(DL2) on the data line DL2. Before the Vcom voltage is switched to a high voltage level (+4.3V), the voltage V'(DL2) on the second data line DL(2) maintains at the voltage (+1V) of previous pixel voltage. After the Vcom voltage is switched to the high voltage level, that is, after the time point T1 labeled in FIG. 8B, the voltage V'(DL2) changes to +6V along with the change of the Vcom voltage (increase by +5V). Because the switch controlling signal CS2' is enabled at time point T3, the voltage V'(DL2) maintains at +6V for about two enabled periods of the switch controlling signals CS'. When the second switch SW2 is turned on after time point T3, the +6V voltage V'(DL2) changes to a +2V pixel voltage outputted by the data driving unit 202 and maintains at +2V for about four enabled period of the switch controlling signals CS'. The changes after time point T1' are similar to the above disclosure and are not repeated here.

Figure 8C:
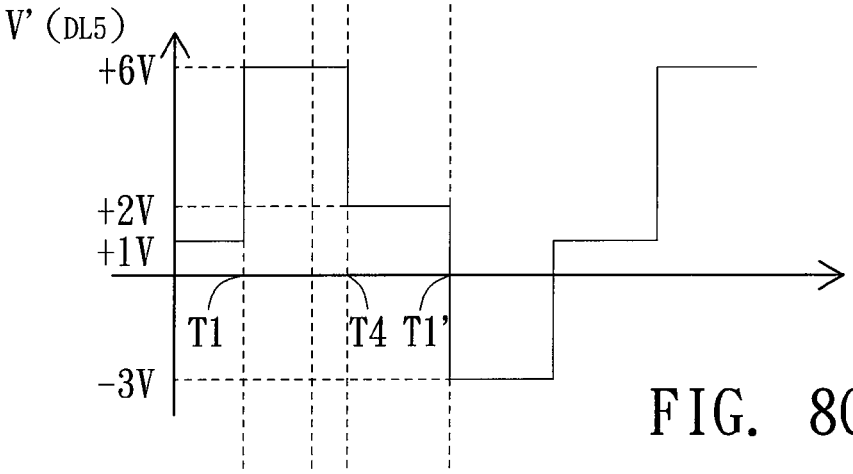
FIG. 8C is a diagram showing changes of voltage V(DL5) on the data line DL5.

Next, referring to FIG. 8C, a diagram showing changes of voltage V'(DL5) on the data line DL(5) is shown. The changes of the voltage V'(DL5) on the data line DL(5) before and after the switch SW5 is turned on are shown in FIG. 8C. The switch controlling signal CS5' is advanced to be enabled earlier at time point T4 compared to signal CS5 in FIG. 4A, but the switch controlling signal CS2' is delayed to be enabled at time point T3 compared to signal CS2 in FIG. 4A. Looking from time point T1', the duration of the source X1 of the second thin-film transistor TFT(2) maintaining at +3V is two enabled period of the switch controlling signal CS', and so does the duration of the source X1 maintaining at +6V. The duration of the source X2 of the thin-film transistor TFT(5)maintaining at −3V or +6V are three enabled period of the switch controlling signal CS'. The difference of the duration of maintaining at −3V or +6V at the source X1 and the duration of at −3V or +6V at the source X2 are only one enabled period of the switch controlling signal CS'. By doing so, within a unit time, such as one enabled period of a scanning signal Scan, the TFT(2) and TFT(5) would have almost the same leakage currents. This implies that the leakage current of the green pixel 100(2) through TFT(2) and the leakage current of the green pixel 100(5) through TFT(5) are almost the same. That is, compared with what would be displayed according to the signal CS1~CS6 in FIG. 3, after receiving the same pixel voltage, the luminance or color displayed by the pixel 100(2) and the luminance or color displayed by the pixel 100(5) by applying the signal CS1'~CS6' in FIG. 7 would be almost the same. Finally, when the trend in design of liquid crystal display is headed towards large scale, one data driving unit can drive a plurality of pixels, so that the image quality of liquid crystal display can be improved and that the manufacturing cost can be reduced.

Besides, the embodiment of the method for driving liquid crystal display according to the invention does not limit the sequence in driving the same color pixels 100. For example, the sequence in driving the red pixels 100(1) and 100(4) can be that the red pixel 100(1) comes before or after the red pixel 100(4).

Second Embodiment

Figure 9:
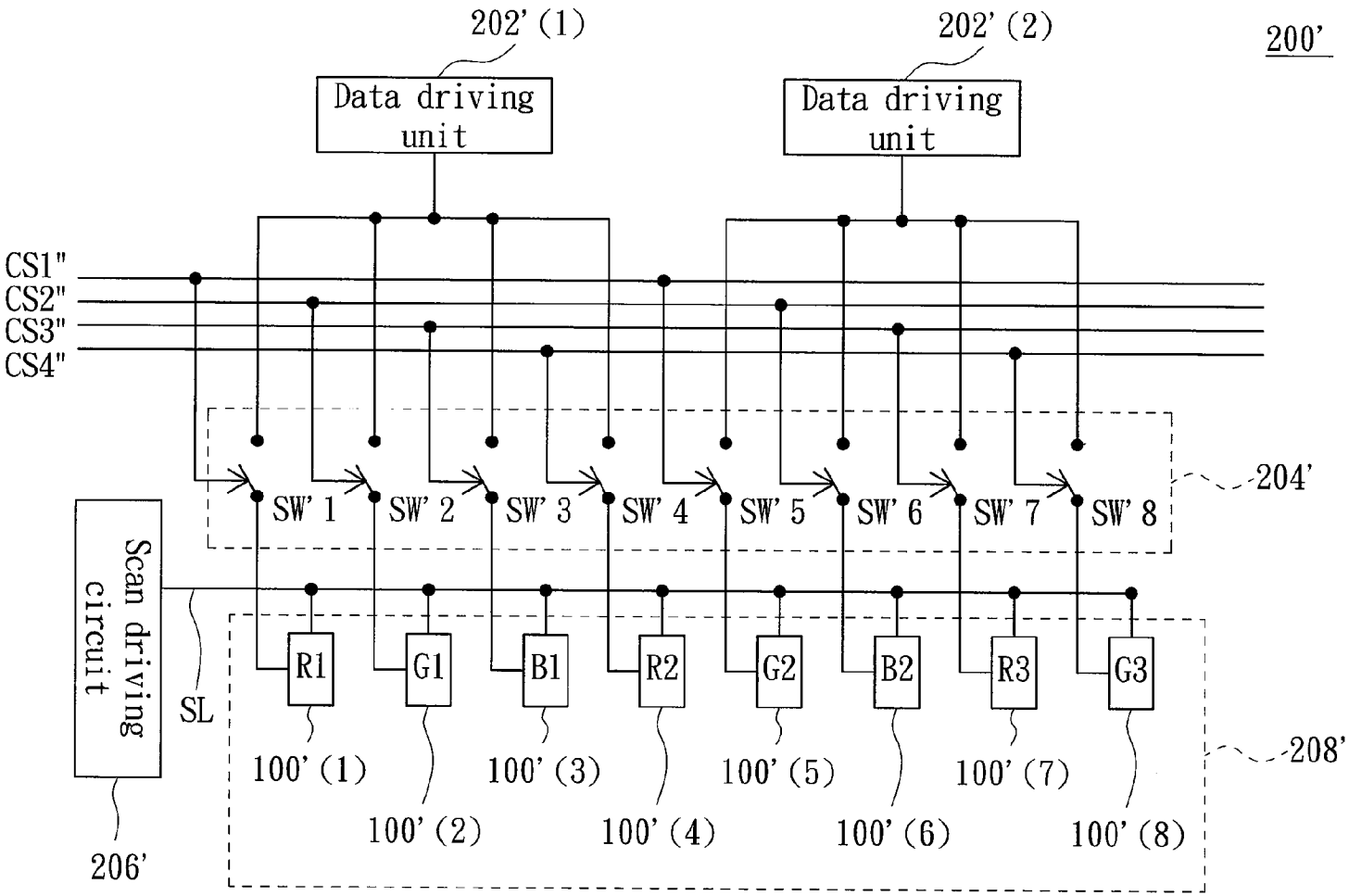
FIG. 9 is a diagram of partial circuit structure of a liquid crystal display according to a second embodiment of the invention.

Referring to FIG. 9, a diagram of partial circuit structure of a liquid crystal display according to a second embodiment of the invention is shown. The present is exemplified by driving four pixels by one data driving unit. The liquid crystal display 200' includes two data driving units 202'(1) and 202'(2), a switch set 204', a scan driving circuit 206' and a pixel array 208'. The pixel array 208' includes eight pixels 100'(1)~100'(8). The eight pixels 100'(1)~100'(8) are labeled R1, G1, B1, R2, G2, B2, R3, and G3. Among the four pixels 100' driven by the data driving unit 202', at least two of the four pixels 100' are of the same color. For example, the data driving unit 202'(1) drives two red pixels 100'(1) and 100'(4), and the data driving unit 202'(2) drives two green pixels 100'(5) and 100'(8).

Both the two data driving units 202'(1) and 202'(2) sequentially drive two pixels of the same color first (that is, the red pixels 100'(1) and 100'(4), and the green pixels 100'(5) and 100'(8)), and then sequentially drives the pixels 100'(2), 100'(3), 100'(6) and 100'(7) of another two colors. For example, within the enabled period of the scanning signal Scan, the switch controlling signal CS1" can be enabled first, so that the red pixel 100'(1) and the green pixel 100'(5) receive the pixel voltage. Next, the switch controlling signal CS4" is enabled, so that another red pixel 100'(4) and another green pixel 100'(8) receive the pixel voltage. Therefore, among the four pixels 100' driven by each data driving unit 202', the pixels generating the light of the same color, namely, the pixel 100'(1) and 100'(5), and the pixel 100'(4) and 100'(8), are sequentially driven first. Afterwards, the switch controlling signals CS2" and CS3" are sequentially enabled, so that the first data driving unit 202'(1) sequentially drives the green pixel 100'(2) and the blue pixel 100'(3), and the second data driving unit 202'(2) sequentially drives the blue pixel 100'(6) and the red pixel 100'(7). It is noteworthy that the sequence in enabling the switch controlling signals CS2" and CS3" are not restricted. For example, either the switch controlling signal CS2" or the switch controlling signal CS3" can be enabled first. That is, the pixels 100'(2) and 100'(6) are driven first, then the pixels 100'(3) and 100'(7) are driven afterwards. Or, the pixels 100'(3) and 100'(7) are driven first, then the pixels 100'(2) and 100'(6) are driven afterwards.

Moreover, the switch controlling signals CS2" and CS3" can be sequentially enabled first, and then the switch controlling signals CS1" and CS4" are sequentially enabled afterwards. Take the data driving unit 202'(1) for example, the data driving unit 202'(1) sequentially drives the pixel 100'(2) and 100'(3) first, and then sequentially drives the pixel 100'(1) and 100'(4) afterwards. The sequence in sequentially driving the pixels 100'(2) and 100'(3) and sequentially driving the pixels 100'(1) and 100'(4) are not restricted. As long as all the pixels 100' of the same color are driven before the pixel 100' of another color are driven, the pixels of the same color 100' would have almost the same leakage current, hence improving the image quality.

A method for driving liquid crystal display is disclosed in the above embodiment of the invention. Among the pixels driven by the same data driving unit, the pixels of the same color are sequentially driven, so that the pixels have almost the same leakage current. When the trend in design of liquid crystal display is headed towards large scale design, the invention not only reduces the manufacturing cost of liquid crystal display, but also maintains better image quality.

While the invention has been described by way of example and in terms of preferred embodiments, it is to be understood that the invention is not limited thereto. Rather, it is intended to cover various modifications and similar arrangements and procedures, and the scope of the appended claims therefore should be accorded the broadest interpretation so as to encompass all such modifications and similar arrangements and procedures.

What is claimed is:

1. A method for driving a liquid crystal display, the liquid crystal display comprising a pixel array, a scan driving circuit and a first data driving unit and a second data driving unit, the scan driving circuit outputting a scanning signal to a scan line, the first data driving unit and the second data driving unit selectively and electrically connected to the pixel array the pixel array electrically connected to the scan line, the pixel array including at least a first and a second pixel group, both the first pixel group and the second pixel group having a first color, a second color and a third color, at least two of pixels among the first pixel group being of the same color, at least two of pixels among the second pixel group being of the same color, the method comprising:

enabling the scanning signal;

sequentially driving all pixels of the first color in the first pixel group and then all pixels of the second color in the first pixel group; and sequentially driving all pixels of the second color or the third color in the second pixel group and then all pixels of the first color or the third color in the second pixel group, wherein at any moment, the driven pixel in the first pixel group and the driven pixel in the second pixel group are of different colors.

2. The method according to claim 1, wherein:

both the first pixel group and the second pixel group have first color pixels, second color pixels and third color pixels;

the step of sequentially driving all pixels of the first color in the first pixel group and then all pixels of the second color in the first pixel group further comprises: sequentially driving all the first color pixels, then all the second color pixels and further then all the third color pixels; and the step of sequentially driving all pixels of the second color or the third color in the second pixel group and then all pixels of the first color or the third color in the second pixel group further comprises: sequentially driving all the second color pixels, then all the third color pixels and further then all the first color pixels,

3. The method according to claim 1, wherein:

both the first pixel group and the second pixel group have first color pixels, second color pixels and third color pixels;

the step of sequentially driving all pixels of the first color in the first pixel group and then all pixels of the second color in the first pixel group further comprises: sequentially driving all the first color pixels, then all the third color pixels and further then all the second color pixels; and the step of sequentially driving all pixels of the second color or the third color in the second pixel group and then all pixels of the first color or the third color in the second pixel group further comprises: sequentially driving all the second color pixels, then all the first color pixels and further then all the third color pixels.

4. The method according to claim 1, wherein:

both the first pixel group and the second pixel group have first color pixels, second color pixels and third color pixels;

the step of sequentially driving all pixels of the first color in the first pixel group and then all pixels of the second color in the first pixel group further comprises: sequentially driving all the second color pixels, then all the third color pixels and further then all the first color pixels; and the step of sequentially driving all pixels of the second color or the third color in the second pixel group and then all pixels of the first color or the third color in the second pixel group further comprises: sequentially driving all the third color pixels, then all the first color pixels and further then all the second color pixels.

5. The method according to claim 1, wherein:

both the first pixel group and the second pixel group have first color pixels, second color pixels and third color pixels;

the step of sequentially driving all pixels of the first color in the first pixel group and then all pixels of the second color in the first pixel group further comprises: sequentially driving all the third color pixels, then all the second color pixels and further then all the first color pixels; and the step of sequentially driving all pixels of the second color or the third color in the second pixel group and then all pixels of the first color or the third color in the second pixel group further comprises: sequentially driving all the first color pixels, then all the third color pixels and further then all the second color pixels.

6. A liquid crystal display, comprising:

a pixel array including at least a first and a second pixel group, both the first pixel group and the second pixel group having a first color, a second color and a third color, at least two of pixels among the first pixel group being of the same color, at least two of pixels among the second pixel group being of the same color, a first data driving circuit having a first output end, driving the first pixel group;

a second data driving circuit having a second output end, driving the second pixel group;

N switches, wherein each switch has a first ends and a second end, the first ends of the N switches are electrically connected to the first output end or the second output end, and the second ends of the N switches are respectively and electrically connected to a corresponding pixel of the pixel array, the first and the second data driving circuit are selectively and electrically connected to the pixel array via the switches; and a scan driving circuit for outputting a scanning signal to the scan line, wherein when the scanning signal is enabled, the N switches are sequentially turned on, such that the first data driving circuit sequentially drives all pixels of the first color in the first pixel group and then all pixels of the second color in the first pixel group, the second data driving circuit sequentially drives all pixels of the second color or the third color in the second pixel group and then all pixels of the first color or the third color in the second pixel group, wherein at any moment, the driven pixel in the first pixel group driven by the first data driving circuit and the driven pixel in the second pixel group driven by the second data driving circuit are of different colors.

7. The liquid crystal display according to claim 6, wherein:

the first data driving circuit sequentially drives all the first color pixels, then all the second color pixels and further then all the third color pixels of the first pixel group; and the second data driving circuit sequentially drives all the second color pixels, then all the third color pixels and further then all the first color pixels of the second pixel group.

8. The liquid crystal display according to claim 7, wherein:

the first data driving circuit sequentially drives all the first color pixels, then all the third color pixels and further then all the second color pixels of the first pixel group; and the second data driving circuit sequentially drives all the second color pixels, then all the first color pixels and further then all the third color pixels of the first pixel group.

9. The liquid crystal display according to claim 8, wherein:

the first data driving circuit sequentially drives all the second color pixels, then all the third color pixels and further then all the first color pixels of the first pixel group; and the second data driving circuit sequentially drives all the third color pixels, then all the first color pixels and further then all the second color pixels of the second pixel group.

10. The liquid crystal display according to claim 6, wherein the first data driving circuit sequentially drives all the third color pixels, then all the second color pixels and further then all the first color pixels of the first pixel group; and the second data driving circuit sequentially drives all the first color pixels, then all the third color pixels and further then all the second color pixels of the first pixel group.

* * * * *